United States Patent [19]

Borgstrom Alan D. et al.

[11] Patent Number: 4,913,658

[45] Date of Patent: Apr. 3, 1990

[54] LOADBREAK PISTON STOP AND LOCKOUT

[75] Inventors: Borgstrom Alan D., Hackettstown, N.J.; George R. Hydock, Mount Bethel, Pa.

[73] Assignee: Amerace Corporation, Parsippany, N.J.

[21] Appl. No.: 387,778

[22] Filed: Aug. 1, 1989

[51] Int. Cl.[4] ..... H01R 13/53

[52] U.S. Cl. ..... 439/185; 439/921

[58] Field of Search ..... 439/181–187, 439/921

[56] References Cited

U.S. PATENT DOCUMENTS

| | | | |
|---|---|---|---|
| 3,884,542 | 5/1975 | Flatt | 439/185 |
| 3,930,709 | 1/1976 | Stanger et al. | 439/607 |
| 3,957,332 | 5/1976 | Lambert, III | 439/183 |
| 4,186,985 | 2/1980 | Stepniak et al. | 439/607 |
| 4,773,872 | 9/1988 | Borgstrom et al. | 439/187 |

FOREIGN PATENT DOCUMENTS

| | | | |
|---|---|---|---|
| 2304197 | 10/1976 | France | 439/184 |

*Primary Examiner*—Gary F. Paumen

*Attorney, Agent, or Firm*—David Teschner

[57] ABSTRACT

A series of lanced sections are provided at the end of a movable female contact assembly in a loadbreak bushing insert to limit its extent of travel during fault closure conditions and prevent its unwanted removal from the insert housing. A locking ring is added ahead of the lanced sections to cause same to become locks by displacement from their normal positions making resetting of the female contact assembly impossible and providing a visual indication that the bushing has been involved in a fault closure situation.

9 Claims, 4 Drawing Sheets

LOADBREAK PISTON STOP AND LOCKOUT

RELATED APPLICATION

High-voltage loadbreak bushing insert connector by Alan D. Borgstrom, Frank, M. Stepniak and Andrew A. Kominiak, U.S. Pat. No. 4,863,392, issued Sept. 5, 1989 and assigned to the Assignee of the instant invention.

BACKGROUND OF THE INVENTION

1. Field of the Invention

The invention relates to high-voltage separable connectors and more particularly to loadbreak bushing inserts with piston-operated movable female contact assemblies propelled by the production of arc-quenching gases within such inserts during fault closure and activated operations.

2. Description of the Prior Art

The description of the prior art and the reasons for the general configuration of the present device are fully set forth in the above-cited related patent which is incorporated herein by reference to such patent.

In the device of the related patent, it is possible to reuse the bushing insert connector 200 by returning the female contact assembly 222 to its initial position shown in FIG. 5 by use of an appropriate tool (not shown) inserted between the female contacts 224 to engage the front face of piston 226. Under many conditions, this procedure may be repeated a number of times without impairing the operation of the connector. Reuse may be determined by the condition of the female contacts 224, the snuffer tube 230 and the general condition of the body portion 202 and any other factors considered significant.

However, some users of the device described above do not permit any reuse of a component part of a high-voltage loadbreak system which has been involved in a fault closure situation. They prefer that the device indicate that it has been involved in such a fault closure situation and that the device be made non-reusable.

SUMMARY OF THE INVENTION

The instant invention provides a lockout mechanism which both prevents reuse of the connector and whose operated state is immediately visible to any inspector. As described in the aforementioned patent, the entire female contact assembly 222 is advanced out of the non-metallic sleeve 212 and elongated body portion 202 as is seen in FIG. 2 of the aforementioned patent to give an inspector an immediate indication that the device has been operated in response to a fault closure.

A series of peripheral lanced sections 274 adjacent end 272 of tubular extension 232, as is shown in FIG. 10 of the aforementioned patent, act as stops for the female contact assembly 222 by engaging stop surfaces 268 of ring 266. To provide a lockout of the female contact assembly and prevent its resetting into the body portion 202, a ring is added adjacent the free ends of the lanced sections 274. When this ring engages stop surfaces 268 of the ring 266, it pushes against the lanced free ends and displaces them into biting engagement with the outer surface of the contact 236. The degree of displacement will vary up to the point of being perpendicular to the longitudinal axis of the contact 236 and acts as a one-way clutch preventing the movement of the female contact assembly 222 back to its initial position. It is an object of this invention to provide a lockout mechanism for a high-voltage loadbreak bushing insert connector.

It is an object of this invention to provide a lockout mechanism for a high-voltage loadbreak bushing insert connector operated under fault closure conditions.

It is another object of this invention to provide a high-voltage loadbreak bushing insert connector that indicates it has been involved in a fault closure situation and which is locked out against reuse.

Other objects and features of the invention will be pointed out in the following description and claims and illustrated in the accompanying drawings, which disclose, by way of example, the principles of the invention, and the best modes which have been contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
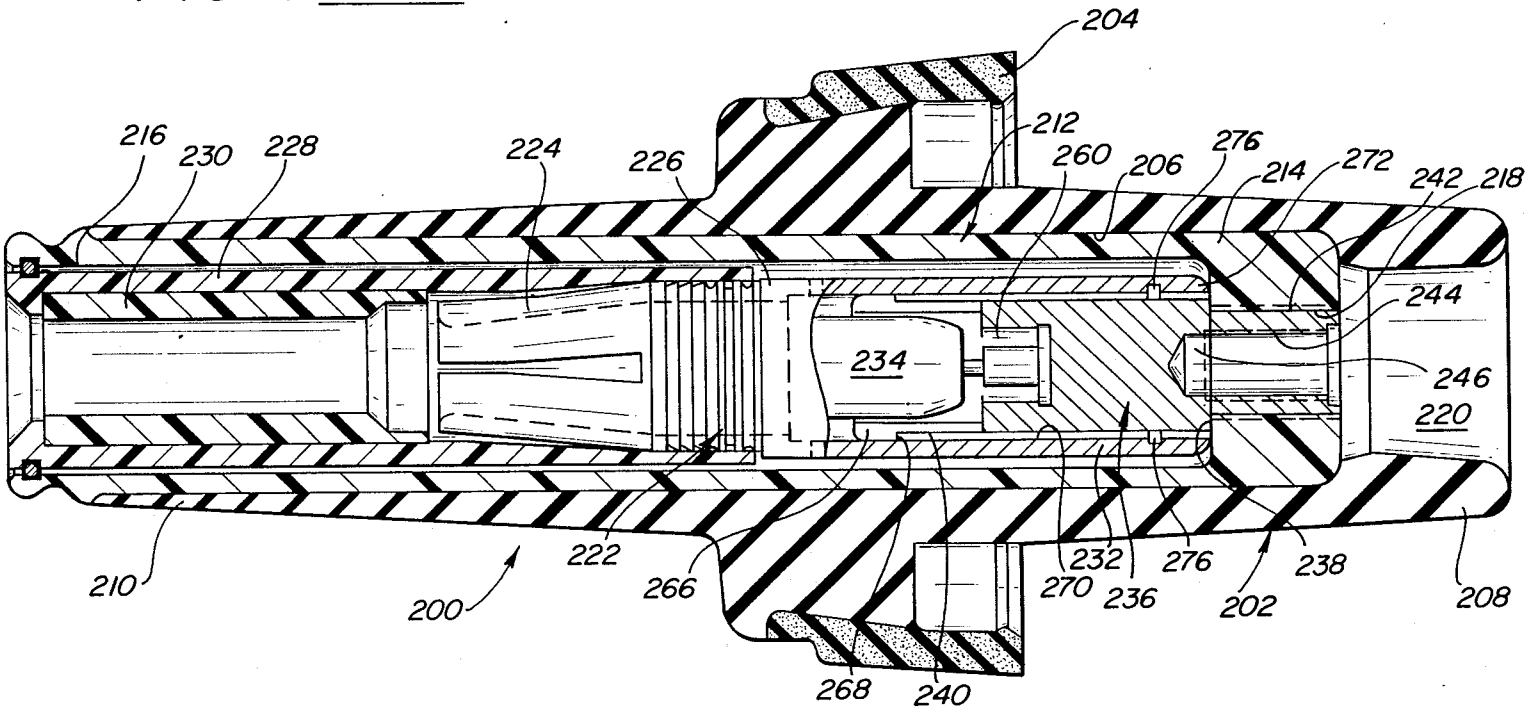
FIG-1 PRIOR ART
FIG. 1 is a side elevation, in section, of a bushing insert constructed in accordance with the concepts of the invention of the related patent and is FIG. 5 of such patent.
Figure 2:
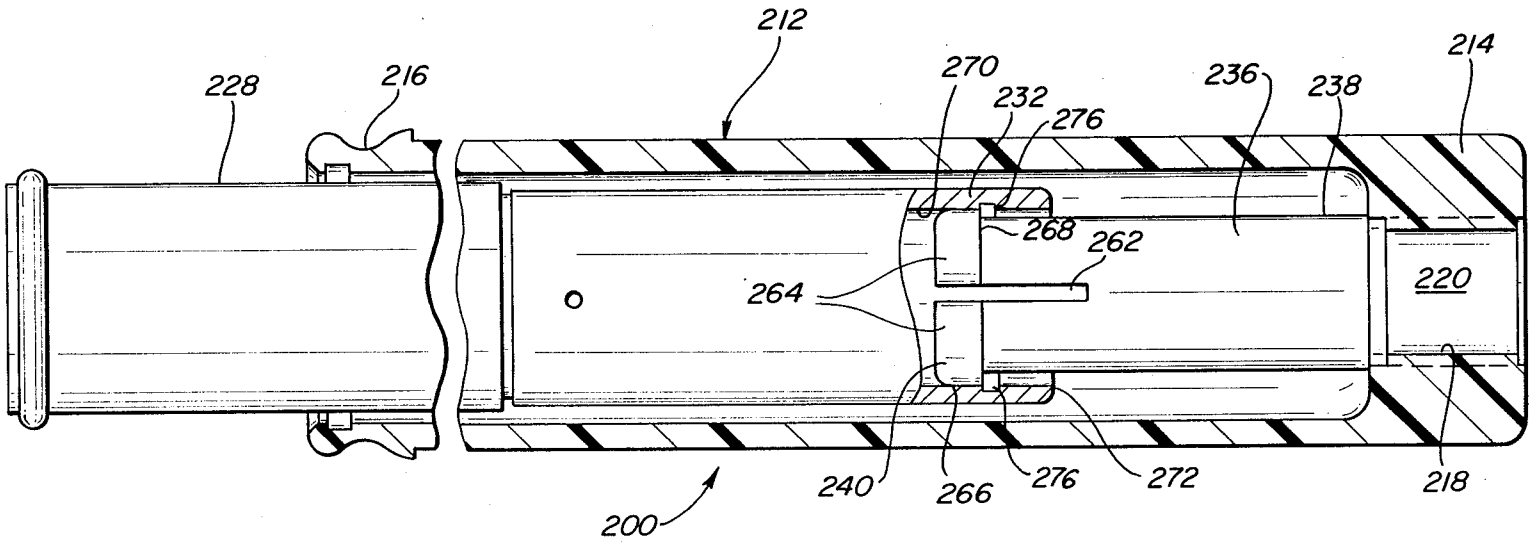
FIG-2 PRIOR ART
FIG. 2 is a side elevation, in section and foreshortened, showing a portion of the bushing insert of FIG. 1 in an operated state and is FIG. 6 of the aforementioned patent.

Turning now to FIGS. 1 and 2, there is shown a first embodiment of a bushing insert 200 constructed in accordance with the concepts of the invention as set forth in the aforementioned patent. Bushing insert 200 is composed of an elongated body portion 202 fabricated from an insulating material such as rubber, synthetic rubber, plastic or the like and may be EDPM rubber. Placed about a portion of the exterior of body portion 202 is a semi-conductive layer 204 such as conductive EDPM rubber. A longitudinal bore 206 extends the entire length of the body portion 202 from a first end 208 to a second end 210. Fitted within bore 206, for its entire length is a non-metallic sleeve 212 having a substantially closed end 214 adjacent first end 208 of body portion 202 and an open end 216 formed as a nose-piece adjacent second end 210 of body portion 202. This unitary construction of non-metallic sleeve 212 eliminates the need for a separately molded nose-piece which must be joined to the body portion 202. Sleeve 212 is molded of conductive plastic or is coated with a conductive material such as paint or the like so that an equipotential level is maintained along its length. It eliminates an assembly operation and decreases air pockets which could lead to corona discharges.

A passage 218 through end 214 of sleeve 212 communicates with recess 220 which receives a portion of a bushing well (not shown).

Placed within non-metallic sleeve 212 for its entire length is a movable female contact assembly 222 consisting essentially of the female contacts 224, an operating piston 226, a plastic sleeve 228, an arc-quenching gas-generating sleeve 230 and a hollow tubular metallic extension 232. As is well known in the art, upon the attempted closure of the male contact probe with the female contacts in a bushing insert when the circuit is activated or there is a ground fault, an arc is struck and continues until a solid electrical contact is made. To minimize the destructive effects of the arc, an arc-quenching gas is generated to snuff the arc as quickly as possible. Thus, as the male contact probe (not shown) approaches female contacts 224, an arc (not shown) is struck which passes along the surface of sleeve 230 causing the generation of arc-quenching gases which are directed toward end 208 of body portion 202 into chamber 234. When the pressure of the gases in chamber 234 is high enough, it acts upon piston 226 to move the entire female contact assembly 222 toward end 210 of body portion 202, as is shown in FIG. 2 to, firmly establish contact between the female contacts 224 and the male contact probe (not shown). The tubular extension 232 is similarly moved by movement of assembly 222.

Within tubular extension 232 of the movable female contact assembly 222 is contact 236 which is substantially solid at a first end 238 adjacent substantially closed end 214 of non-metallic sleeve 212 and is tubular at a second end 240 adjacent piston 226 of female assembly 222.

Adjacent first end 238 is a tubular extension 242 of reduced exterior dimension and externally threaded to facilitate assembly of the contact 236 with sleeve 212 at the substantially closed end 214. A stud of the bushing well (not shown) is threaded into threaded bore 244 of the extension 242 into a threaded bore extension 246 in the main portion of contact 236.

Figure 3:
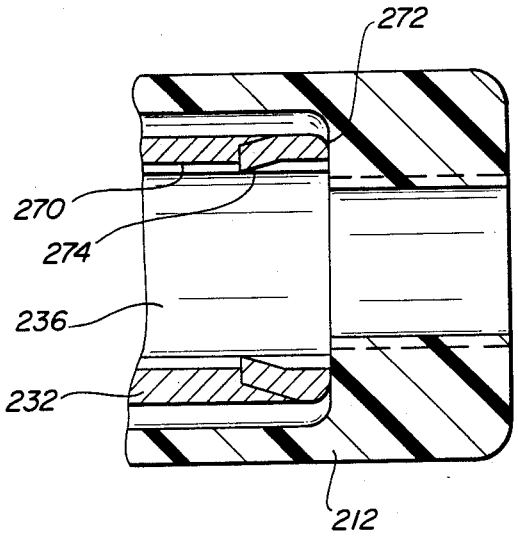
FIG-3 PRIOR ART
FIG. 3 is a fragmentary side elevation, in section, of an alternative form of female contact assembly stop mechanism and is FIG. 10 of the aforementioned patent.

End 240 of contact 236, as stated above is generally tubular so that it can receive the end of the male contact probe. Contact 236 can be turned upon a stud of the bushing well (not shown) by a suitable tool (not shown) inserted into socket 260 of contact 236. This will rotate the bushing insert 200 at the same time. Tubular end 240 is slotted as at 262 to provide a series of spring fingers 264. An annular ring 266 can be provided about the outer surface of contact 236 adjacent end 240 to further increase the contact surface of the fingers 264. Ring 266 is similarly slotted. Additionally, a ring spring 269 (FIGS. 5 and 6) can be placed within contact 236 adjacent end 240 to deflect fingers 264 outwardly to increase the contact with the inner surface 270 of the tubular extension 232. The rear face 268 of the annular ring 266 acts as a stop surface as will be described below. The outer surface of ring 266 makes solid electrical contact within inner surface 270 of the tubular extension 232 over the entire range of movement of the movable female contact assembly 222 and with the bushing well onto which the bushing insert 200 is assembled. While the discussion thus far has been in terms of a bushing well with stud and a bushing insert with threaded receptacle, the two could be reversed so as to provide the bushing insert with the stud while the bushing well is provided with a threaded receptacle. A stop arrangement, as is shown in FIG. 3, involves lancing the end 272 of extension 232 to form inwardly directed lance tabs 274 which can engage stop surface 268 to limit movement of assembly 222 toward end 210 of body portion 202. At least two lance tabs 274 set at opposed positions on the periphery of the tubular extension 232 are required to keep extension 232 balanced and free to move. Although the primary current path is by means of the fingers 264 and ring 266 which can carry all required current during the steady state and fault closure conditions, the lance tabs 274 act as a secondary path both during steady state and fault closure conditions. If sufficient tabs are present, it has been found by actual test that such tabs can handle all required currents independently.

Figure 4:
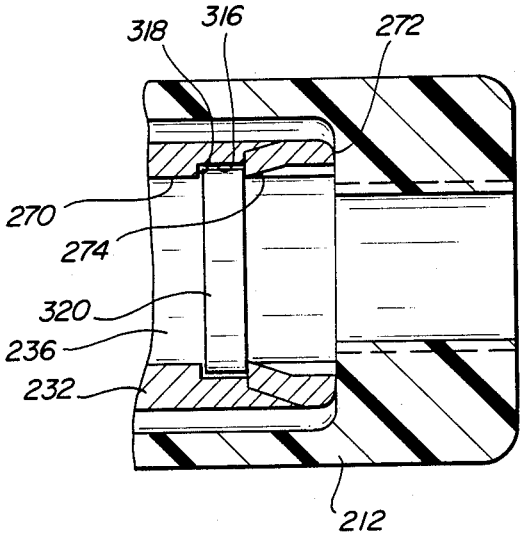
FIG. 4 is a fragmentary side elevation, in section, similar to FIG. 3 but showing the modification thereof in accordance with the concepts of the invention.

Turning now to FIG. 4, the lockout mechanism of the instant invention is set forth. A ring 320 having a diameter slightly larger than the interior diameter of tubular extension 232 is set just ahead and in contact with the free ends of the lance tabs 274. A recess 316 in the interior surface 270 of tubular extension 232 provides a stop shoulder 318 to prevent movement of the ring 320 forward with the movement of the female contact assembly 222 and assures its position adjacent the free ends of lance tabs 274 as is shown in FIG. 4.

Figure 5:
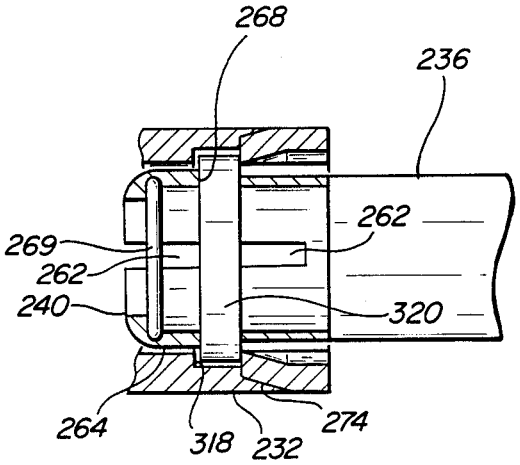
FIG. 5 is a fragmentary side elevation, in section, of the modification of FIG. 4 showing the positions of the component parts prior to operation.

Under fault closure conditions, the female contact assembly 222 moves as above described until the components arrive at the positions shown in FIG. 5. The female contact assembly 222 has almost reached the full extent of its travel. Ring 320 is resting against stop surface 268 of annular ring 266 and against the free ends of the lance tabs 274. If movement of female contact assembly 222 stopped at this point, it could be reset to its initial position as in FIG. 1.

Figure 6:
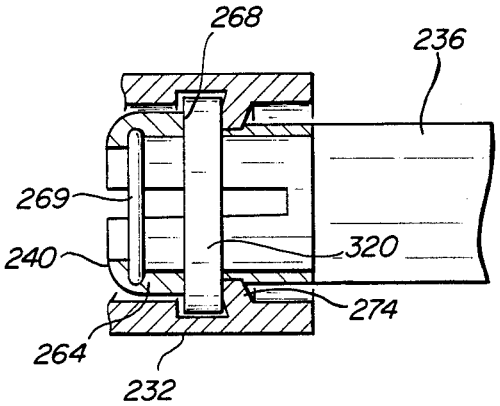
FIG. 6 is a fragmentary side elevation, in section, of the modification of FIG. 4 after the lockout operation is complete.

The further movement of the female contact assembly 222 to its fullest extent, as is shown in FIG. 6, causes the lance tabs 274 to be driven inwardly away from ring 320 and to bite into the metal of the contact 236, thus locking the female contact assembly 222 and the contact 236 together and preventing the resetting of the female contact assembly 222 into the position of FIG. 1 and making the fact of fault closure obvious to any inspector. The degree of rotation and biting of the lance tabs 274 into contact 236 will vary depending upon the metals used, the forces and speed involved, etc. Sufficient rotation of the lance tabs 274 will occur up to a maximum of a position substantially perpendicular to the longitudinal axis of the tubular extension 232 and contact 236, as is shown in FIG. 6, to provide a one-way clutch and the desired lockup of these components.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined as follows:

We claim:

1. In a high-voltage loadbreak bushing insert of the type having an elongate, insulative body member with a central bore extending from a first end to a second end: a static metallic contact means within said body member, said contact means having a first portion arranged to be coupled to the conductive stud of a high-voltage bushing well; and a second portion remote from said first portion of said contact means having a plurality of contact members; a movable female contact assembly positioned within said central bore of said body member for movement therein from a first position adjacent said first end of said body member to a second position closer to said second end of said body member; said movable female contact assembly comprising a female contact and a hollow tubular metallic sleeve portion having a first end coupled to said female contact and a second free end remote from said female contact, the interior surface of said metallic sleeve portion engaging said contact members of said contact means as said female contact assembly moves from said first position to said second position; the improvement comprising stop means to prevent the movement of said female contact assembly to said first position once said female contact assembly has moved from said first position to said second position.

2. A stop means as defined in claim 1, comprising at least two opposed lanced sections in said hollow tubular metallic sleeve portion adjacent said second free and directed inwardly into the interior of said hollow tubular metallic sleeve portion; and a ring positioned in the inner surface of said hollow tubular metallic sleeve portion adjacent the free ends of said lanced sections to engage said free ends and displace same into locking engagement with said contact means when said hollow tubular metallic sleeve portion moves to said second position.

3. A stop means as defined in claim 2, wherein the free ends of said lanced sections bit into said contact means and act as a one-way clutch to prevent said hollow tubular metallic portion from being returned to said first position.

4. A stop means as defined in claim 2, wherein the free ends of said lanced sections are displaced generally perpendicular to the longitudinal axis of said contact means and bite into said contact means to act as a one-way clutch to prevent said hollow tubular metallic portion from being returned to said first position.

5. A stop means as defined in claim 2, wherein there are two said lanced sections.

6. A stop means as defined in claim 2, wherein there are a plurality of said lanced sections arranged around the periphery of said tubular metallic sleeve portion adjacent said second free end.

7. A stop means as defined in claim 2, wherein the inner surface of said tubular metallic sleeve portion contains a first stop shoulder adjacent said second free end to engage said ring and prevent its movement in the direction of said second position of said female contact assembly as said female contact assembly moves toward said second position.

8. A stop means as defined in claim 7, wherein said contact members further comprise stop shoulders to engage said ring and force same into contact with said free ends of said lanced sections to engage said free ends and displace same into locking engagement with said contact means when said tubular metallic sleeve portion moves to said second position.

9. A stop means as defined in claim 6, wherein said contact members further comprise stop shoulders to engage said ring and force same into contact with said free ends of said lanced sections to engage said free ends and displace same into locking engagement with said contact means when said tubular metallic sleeve portion moves to said second position.

* * * * *